US006387201B1

(12) United States Patent
Stuart et al.

(10) Patent No.: US 6,387,201 B1
(45) Date of Patent: May 14, 2002

(54) ROTARY HOT FOIL STAMPING MACHINE

(75) Inventors: John M. Stuart, Skokie; Steven P. Cortese, Mount Prospect, both of IL (US)

(73) Assignee: Best Cutting Die Company, Skokie, IL (US)

( * ) Notice: Subject to any disclaimer, the term of this patent is extended or adjusted under 35 U.S.C. 154(b) by 0 days.

(21) Appl. No.: 09/312,330

(22) Filed: May 14, 1999

(51) Int. Cl.[7] ..... B44C 1/16; B32B 31/20; B32B 35/00

(52) U.S. Cl. ..... 156/234; 156/233; 156/238; 156/239; 156/540; 156/543; 101/23; 101/25; 101/DIG. 31

(58) Field of Search ..... 156/230, 233, 156/238, 239, 240, 241, 351, 361, 540, 543, 553, 234; 101/22, 23, 24, 25, 27, 32, DIG. 31

(56) References Cited

U.S. PATENT DOCUMENTS

| | | | | | |
|---|---|---|---|---|---|
| 1,949,362 | A | * | 2/1934 | Wickwire, Jr. | |
| 2,714,268 | A | * | 8/1955 | Battey | |
| 3,022,724 | A | | 2/1962 | Worth | 101/27 |
| 3,584,572 | A | | 6/1971 | Apicella | 101/27 |
| 3,815,494 | A | * | 6/1974 | Bahnmuller | 101/22 |
| 3,926,097 | A | * | 12/1975 | Santa Maria et al. | |
| 4,048,913 | A | | 9/1977 | Navi | 101/27 |
| 4,052,935 | A | | 10/1977 | Ward | 101/11 |
| 4,063,500 | A | | 12/1977 | Abe | 101/25 |
| 4,104,965 | A | * | 8/1978 | Abe | 101/25 |
| 4,545,518 | A | * | 10/1985 | Bergland | |
| 4,744,294 | A | * | 5/1988 | Liepelt et al. | 101/27 |
| 5,109,767 | A | * | 5/1992 | Nyfeler et al. | |
| 5,115,737 | A | | 5/1992 | Amendola | 101/32 |
| 5,117,753 | A | | 6/1992 | Mamberer | 101/225 |
| 5,119,146 | A | | 6/1992 | Nobumori et al. | 355/317 |
| 5,207,855 | A | * | 5/1993 | Nyfeler et al. | 156/351 |
| 5,368,680 | A | * | 11/1994 | Mitsam | |
| 5,520,763 | A | * | 5/1996 | Johnstone | 156/233 |
| 5,590,595 | A | | 1/1997 | Thompson et al. | 101/10 |
| 5,611,272 | A | | 3/1997 | Steuer | 101/23 |
| 6,059,003 | A | * | 5/2000 | Wittkopf | |
| 6,062,134 | A | * | 5/2000 | Eitel et al. | 101/22 X |
| 6,105,651 | A | * | 8/2000 | Leanna | |
| 6,112,651 | A | * | 9/2000 | Eitel et al. | 101/25 |

FOREIGN PATENT DOCUMENTS

| | | |
|---|---|---|
| GB | 2 254 586 | * 10/1992 |
| WO | 98/12051 | * 3/1998 |

* cited by examiner

*Primary Examiner*—Curtis Mayes
(74) *Attorney, Agent, or Firm*—Michael Best & Friedrich, LLC

(57) ABSTRACT

A rotary hot foil stamping machine is provided for repeatedly stamping a foil image onto a continuous product web at a consistent interval along the length of the product web. The rotary hot foil stamping machine includes first and second die stations, each die station comprising a servo driven rotary die holder with at least one removable die attached thereto. Counter rolls are mounted adjacent each die holder such that the outer surfaces of the dies engage the counter rolls as the dies are rotated past the counter rolls. The die holders are driven at a constant speed such that said die surfaces engage the counter rolls simultaneously at regular timed intervals.

29 Claims, 10 Drawing Sheets

ROTARY HOT FOIL STAMPING MACHINE

BACKGROUND OF THE INVENTION

The present invention relates to an improved rotary hot foil stamping machine and an improved method for hot stamping foil images onto a substrate.

Hot foil stamping is a well-known printing process by which decorative images or text may be transferred or "stamped" onto a substrate such as paper. The medium transferred to the substrate may be pigment-based, metal-based, plastic-based or made of other known materials depending on the desired appearance of the final image to be stamped onto the product. Most common foils include five layers. First a polyester film or other carrier provides a flexible protective base on which the remaining layers are supported. Next, a release coat is applied to the carrier layer. The release coat allows the foil pigments and other layers to be separated from the film carrier when the decorative image or text is transferred to the substrate. Below the release coat, a color coat is provided which carries the various pigments which define the color of the transferred image. In metal-based foils, a metal layer, usually aluminum, is then provided to add reflective qualities to the foil image. Finally, an outer adhesive layer is provided to bond the transferred image to the substrate.

A press is provided for transferring the desired foil image onto the substrate. The press acts to stamp or compress, the foil and the substrate together between a heated die and a rigid counter-surface. The heated die includes a raised surface having the form of the image to be applied to the substrate. When the die compresses the foil against the substrate, only the foil area beneath the raised portion of the die is affected. The heat and pressure from the die releases the image-forming layers of the foil from the carrier, and bonds the image to the substrate. Thus, an image corresponding to the raised surface of the die is transferred to the substrate.

Rotary hot foil stamping is a variation of hot foil stamping that is carried out on a rotary press. In a rotary press, the die is cylindrical, with the image portion of the die protruding slightly from the outer circumference of the die. The cylindrical die is mounted adjacent a cylindrical counter roll such that the raised surface of the die engages the outer surface of the counter roll as the die is rotated past it. Both the foil and the product substrate are provided in the form of continuous webs that may be fed between the rotary die and the counter roll. As with other hot foil stamping processes, the die is heated, and when the raised surface of the die compresses the foil web against the product web, the pigments other layers between the raised portion of the die and the counter roll are released from the foil web and bonded to the product substrate. Thus, the foil image is rotationally stamped onto the substrate, as opposed to being vertically stamped as in a platen press.

Rotary hot foil stamping is well-suited for large volume applications in which an image is to be repeatedly stamped along the length of the product web at regular intervals. The product web may then be divided or cut into individual products. Mass mailing pre-printed envelopes, for example, are particularly well-suited for rotary hot foil stamping. Decorative text such as the sender's name and address or other important information may be consistently and accurately stamped along the length of a large paper roll. The pre-printed roll may then be cut up into envelope blanks which are later folded into envelopes. By properly spacing each foil image along the paper roll, the image will appear in exactly the same location on each envelope after it is cut from the web and folded. Of course the aesthetic advantages of rotary hot foil stamping need not be limited to pre-printed envelopes. The appearance of other products such as brochures and fliers and many others products bearing text or decorating images may also be enhanced through the use of rotary hot foil stamping.

A critical production parameter for the rotary hot foil stamping application is the overall product length on the product web. For example, if envelopes are being stamped, the overall product length must correspond to the length of the unfolded envelope blanks. The product length determines the distance separating each image along the length of the product web so that the images will appear in the same position on each product. This requires the product web to be accurately positioned each time a die surface is rotated past the counter roll such that when the next die surface causes the foil to be compressed against the product web, the product web has traveled exactly one product length since the beginning of the previous stamped image.

Another critical production requirement is that during the actual stamping of an image onto the product, the foil web and the product web must be traveling at the same linear speed as the working surface of the die. If the foil or product webs are traveling at speeds different from the die speed, the stamped image will be distorted, or one or the other of the foil and product webs may be torn. In the past, as a practical matter this has meant that the rotational speed of the die has determined the production rate of the entire rotary hot foil stamping process.

Prior art rotary stamping machines rely on the physical size of the rotary die to accurately position images along the product web. The product and foil webs are fed at the same speed as the surface of the die throughout the process. The die may have a single image or multiple images formed around circumference of the die. In order for images to be stamped the proper distance apart, the circumferential distance between adjacent die surfaces must equal the desired distance between images stamped onto the product web. The circumferential distance between image surfaces around the outer circumference of the die is a function of the die's diameter. Therefore, products requiring larger distances between images (corresponding to longer product lengths) require larger diameter dies, whereas short product lengths require smaller diameter dies. In other words, in prior art rotary hot foil stamping machines, the product length is dependent on, and established by, the diameter of the rotary die. Each die must be custom fit for a particular application, with the die circumference being dictated by the product length. Custom made rotary dies are expensive, and the expense has generally had a limiting effect on the use of rotary hot foil stamping, restricting its use to those applications having sufficiently large volumes to justify the production cost of a custom die.

It should be noted, however, that in most applications the foil image is to occupy only a short segment of the overall product length. Therefore, the actual stamping surface of the die is compressed against the foil and product webs for only a brief portion of the entire rotation of the die. At all other times a gap exists between the surface of the rotary die and the counter roll such that both the foil web and the product web can move freely therebetween. Observing this, the present inventors have discovered an improved rotary hot foil stamping machine wherein the foil web and the product web are fed independently of the rotary die and the counter roll. In such a machine, both the foil web and the product web must be accurately and synchronously positioned with respect to the rotating die such that a foil image is repetitively stamped in the proper location on each ensuing product. Further, the foil and product webs must be controlled such that both travel at the same speed as the surface of the die during the actual stamping of the image onto the product web. By removing the correlation between the diameter of the rotating die and the position of the foil and product webs, it becomes possible to provide a standard sized rotating die or a die holder on which dies may be removably attached to form different stamped images, and different product lengths may be selected independently of the diameter of the die or die holder and dies. It also becomes possible to control the foil web independently of the product web so that less foil is wasted between stamped images, thereby increasing the efficiency of the rotary hot foil stamping process.

SUMMARY OF THE INVENTION

The present invention provides an improved rotary hot foil stamping machine, and an improved method for repeatedly hot stamping a foil image along the length of a continuous product web.

According to a preferred embodiment of the invention, the improved rotary hot foil stamping machine includes a die station comprising a rotary die or die holder and a counter roll. In an especially preferred embodiment a rotary die holder is provided which is configured to receive one or more detachable die segments which may be mounted to the outer circumference of the die holder. The product web and a foil web are fed between the die or die holder and the counter roll such that as the die or die holder is rotated, the die surfaces protruding therefrom attached thereto are rotated against the counter roll. As a die surface is rotated past the counter roll, it compresses, or stamps, the foil against the product web and against the counter roll. The die is heated so that the stamping of the foil against the product web releases a foil image from the foil web, and bonds the image to the surface of the product web.

Servo driven feed rolls and pull-through rolls are located respectively on the input and output sides of the die station. The feed rolls and pull-through rolls may be rotated at highly accurate speeds and stopped at precise positions after rotating a preset angular distance, to very accurately position the product and foil webs relative to the rotating die or die holder, which is also driven by a precision servomotor. As the die or die holder rotates, the feed rolls and pull through rolls feed the product web and the foil web through the die station. When the foil image is being stamped the feed rolls and pull-through rolls advance the product and foil webs at feed rates equal to the speed of the rotating die surface. When the stamping surface of the die is rotated clear of the counter roll, however, the product web feed rate is changed to a second product web feed rate so that the product web will be repositioned to the proper location when the next image is stamped onto the product web. The foil web may be slowed between image stampings, to conserve the foil web, or, if a second die station is provided as described below, the foil web feed rate may be increased between image stampings to supply a sufficient length of foil web so that both the first and second die stations are supplied with adequate amounts of foil to simultaneously stamp images at two locations along the length of the product web.

The various feed rates, and the overall position of the product and foil webs relative to the die station, are controlled based on the angular position of the die holder. By synchronizing the feeding of the product and foil webs with the angular position of the die holder, and by altering the product web feed rate during the intervals between image stampings, the distance between stamped images along the length of the product web may be made independent of the diameter of the die holder. Thus, custom dies, or die holders, need not be made each time it is desired to produce a product having a different product length. Instead, all that is required is that new removable die segments be produced incorporating the new desired image and attached to the rotating die holder. The new product length and the new image length must then be entered into the servo control system to adjust the feed rates and feed lengths to match that of the new product. Thus, the cost of producing a new hot foil rotary stamped product is greatly reduced.

Another feature of the present invention is that a second die station may be added to effectively double the speed at which products are conventionally produced. The second die station is substantially identical to the first die station, and is rotated synchronously therewith. Thus, the second die station stamps images simultaneously with the first die station, and, as with the first die station, the product and foil webs may be fed at accelerated feed rates in the intervals between stampings. With a second die station, an additional product length must be fed in the interval between stampings such that both the first and second die stations will be stamping clear areas of the product web that have not been previously stamped. Additional die stations may also be added to further increase production rates, however practical limitations as to how fast the product and foil webs may be fed, and cost factors related to building equipment that can achieve such speeds may limit the efficacy of adding further additional die stations.

The present invention further relates to an improved method for repeatedly hot stamping a foil image onto a product web at regular fixed intervals. The method involves providing a rotary die holder, and mounting at least one rotary die thereto, and providing a counter roll adjacent to and spaced apart from the rotary die holder such that the surface of the die engages the surface of the counter roll as the die is rotated past it. The method further comprises the step of rotating the die holder at a constant speed so that the surface of the die is rotated against the counter roll at regular timed intervals. The next step involves feeding a product web and a foil web between the counter roll and the die holder. The product web and foil web are fed at a first feed rate during the period of the die holder's angular rotation when the surface of the die engages the counter roll, the first feed rate corresponding to the linear velocity of the surface of the rotating die. The product web is fed at a second feed rate in the intervals when the die stamping surface is not in contact with counter roll so that the product web is in the proper location to receive the next stamped image as the next die surface is rotated against the counter roll.

The method may be further refined by providing a second die holder and counter roll, and rotating the second die or die holder synchronously with the first die or die holder, in a manner. similar to the second die station of the improved rotary hot foil stamping machine described above. Upon adding a second die station, the second product feed rate must be adjusted to feed a sufficient length of product web during the intervals between stampings to present clear unstamped product lengths to both the first and second die holders so that two products may be stamped simultaneously. The foil web feed rate must also be adjusted during the between stamping intervals so that sufficient foil is available at each die station to form both sets of images on the product web. By providing the second die station, the production rate of the rotary hot foil stamping process may be effectively doubled.

DETAILED DESCRIPTION OF THE PREFERRED EMBODIMENTS

The major components of an improved rotary hot foil stamping machine in accordance with the present invention are shown in FIGS. 1–5. The major components include an in-feed section 102 illustrated in FIGS. 1 and 2, a stamping section 104 illustrated in FIG. 3, and an out-feed section 106 illustrated in FIGS. 4 and 5. The in-feed section 102 acts to feed a foil wed and a product web into the stamping section 104. The stamping section performs the actual stamping function, repeatedly applying foil images to the product web. Lastly, the out-feed section 106 acts to remove the foil and product webs from the stamping section 104.

Figure 3:
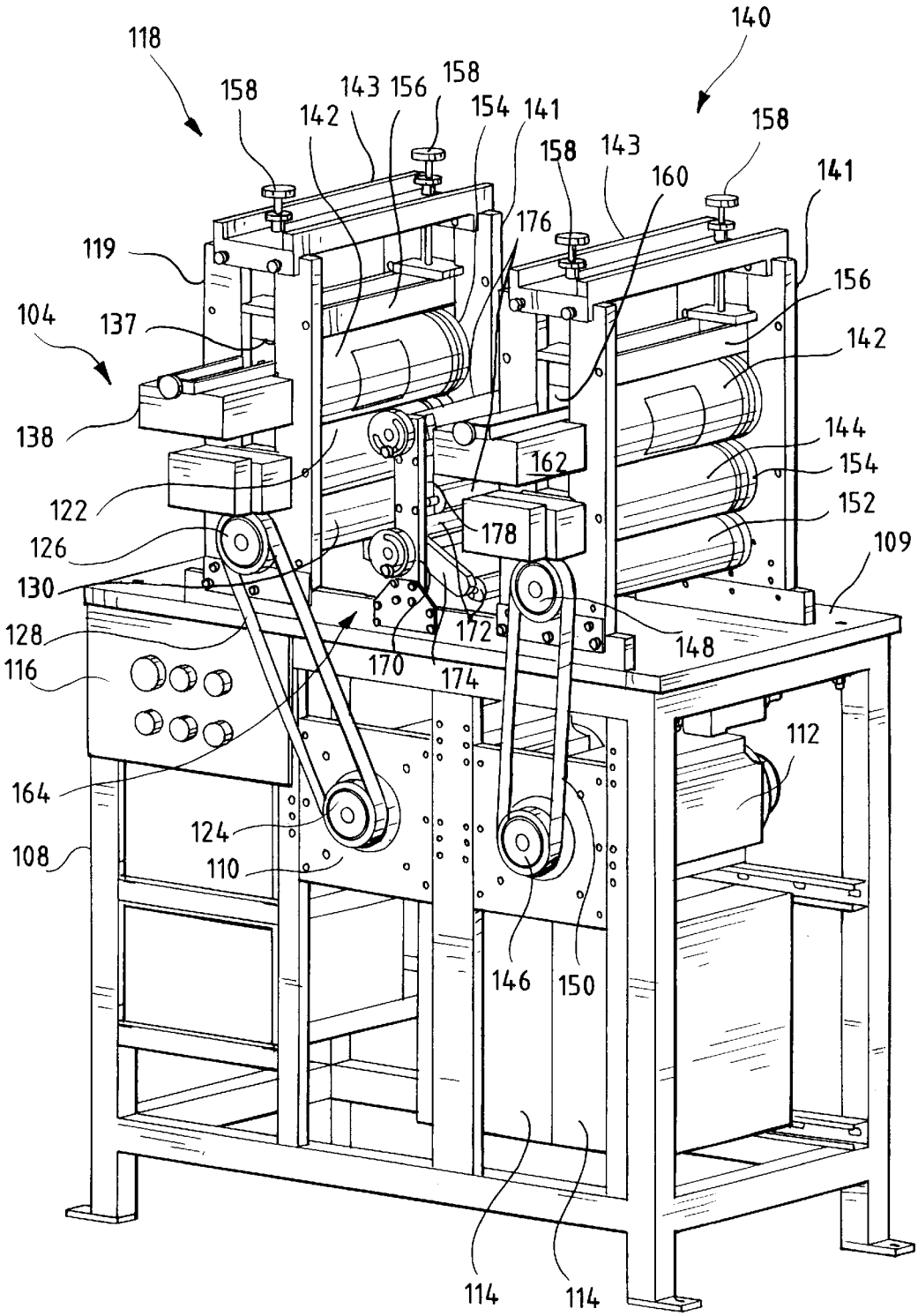
FIG. 3 is a perspective view of the stamping section of a rotary hot foil stamping machine according to a preferred embodiment of the invention.

Stamping section 104 will now be described in detail with reference to FIG. 3. The stamping section includes a steel support base 108 which includes an upper surface 109. First die station and: second die station servomotors 110, 112 are mounted within base 108, as are position controllers 114 for controlling the servomotors 110, 112. A small push-button station 116 for controlling the operation of the rotary hot foil stamping machine is also mounted to the base 108. First die and second die stations 118, 140 are mounted to the upper surface 109 of base 108. A product length adjuster 164 is also mounted to upper surface 109, located between the first and second die stations.

First die station 118 is formed of vertical supports 119 which are anchored to upper surface 109. A horizontal brace member 121 extends between the top of the vertical supports 119, providing further lateral support for the die station. Supported horizontally between the vertical supports 119 are, in ascending order, a first transfer shaft 130, a first counter roll 122, and a first rotary die holder 120.

An output pulley 124 is mounted to the output shaft of first die station drive motor 110. A portion of first transfer shaft 130 extends through a bearing mounted in the vertical support 140, and a first transfer pulley 126 is mounted thereto. A first die station drive belt 128 is installed around output pulley 124 and transfer pulley 126 and couples the rotary output of first die station drive motor 110 to the first transfer shaft 130. Gearing 132 located at the opposite end of transfer shaft 130 couples the rotary output of first die station drive motor 110 to rotary die holder 120. The first counter roll 122 is mounted on roller bearing (not shown) disposed around an eccentric shaft, so that the counter roll 122 is free wheeling. The eccentric roller shaft allows the counter roll to be moved relative to the die holder 120 between an engaged position and a disengaged position.

As will be described in more detail below, removable dies may be mounted to the surface of first die holder 120. The first die holder 120 and the first counter roll are positioned such that during stamping, with the counter roll in the engaged position, the surface of the dies mounted on the die holder will engage the surface of the counter roll as the die holder rotates the dies between the die holder and the counter roll. The desired compression between the die surfaces and the first counter roll 122 is set by rotation of the eccentric bearing on which the first counter roll is mounted. Registration between the die holder and counter roll is maintained by bearer contacts mounted on the die holder axis and the axis of the eccentric roller bearing on which the counter roll is mounted. A registration force is provided, and may be adjusted by turning adjusting screws 136, which extend through tapped holes formed in the horizontal brace member 121. Compression adjustment screws 136 act against compression member 134, which in turn acts against compression adjusting rollers 137. The compression adjusting rollers ride along the surface of die holder bearer contact and press the die holder downward onto bearer contact associated with the counter roll 122. A first heater 138 is mounted on the external surface of vertical support 119, and is provided to heat the dies attached to rotary die holder 120.

The second die station 140 is substantially identical to first die station 118. Vertical supports 141 anchored to upper surface 109 support a second transfer shaft 152, a second counter roll 144, and a second die holder 142. Horizontal brace member 143 extends between the vertical supports 141 to provide additional lateral support, as well as providing a platform for the compression adjusting screws 158, compression member 156, and compression rollers 160. The compressive force between the dies and the counter roll in the second die station 140 is controlled as described with regard to the first die station 118. A second drive motor output pulley 146 is mounted to the output shaft of second die station drive motor 112. A portion of second transfer shaft 152 extends through a bearing mounted in the vertical support 141, and a second transfer pulley 148 is mounted thereto. A second die station drive belt 150 is installed around output pulley 146 and transfer pulley 148 and couples the rotary output of second die station drive motor 112 to the second transfer shaft 152. Gearing 154 located at the opposite end of transfer shaft 152 couples the rotary output of second die station drive motor 112 to second rotary die holder 142. The second counter roll 144 is mounted on roller bearings (not shown) and is free wheeling. As with the first die holder, removable dies may be mounted to the surface of second die holder 142. Compression adjusting screws 158, a compression adjusting member 156, and compression rollers 160 are provided for adjusting the compressive force applied by the dies against the surface of counter roll. A second heater 162 is mounted on the external surface of vertical support 141, and is provided to heat the dies attached to rotary die holder 142.

Figure 6:
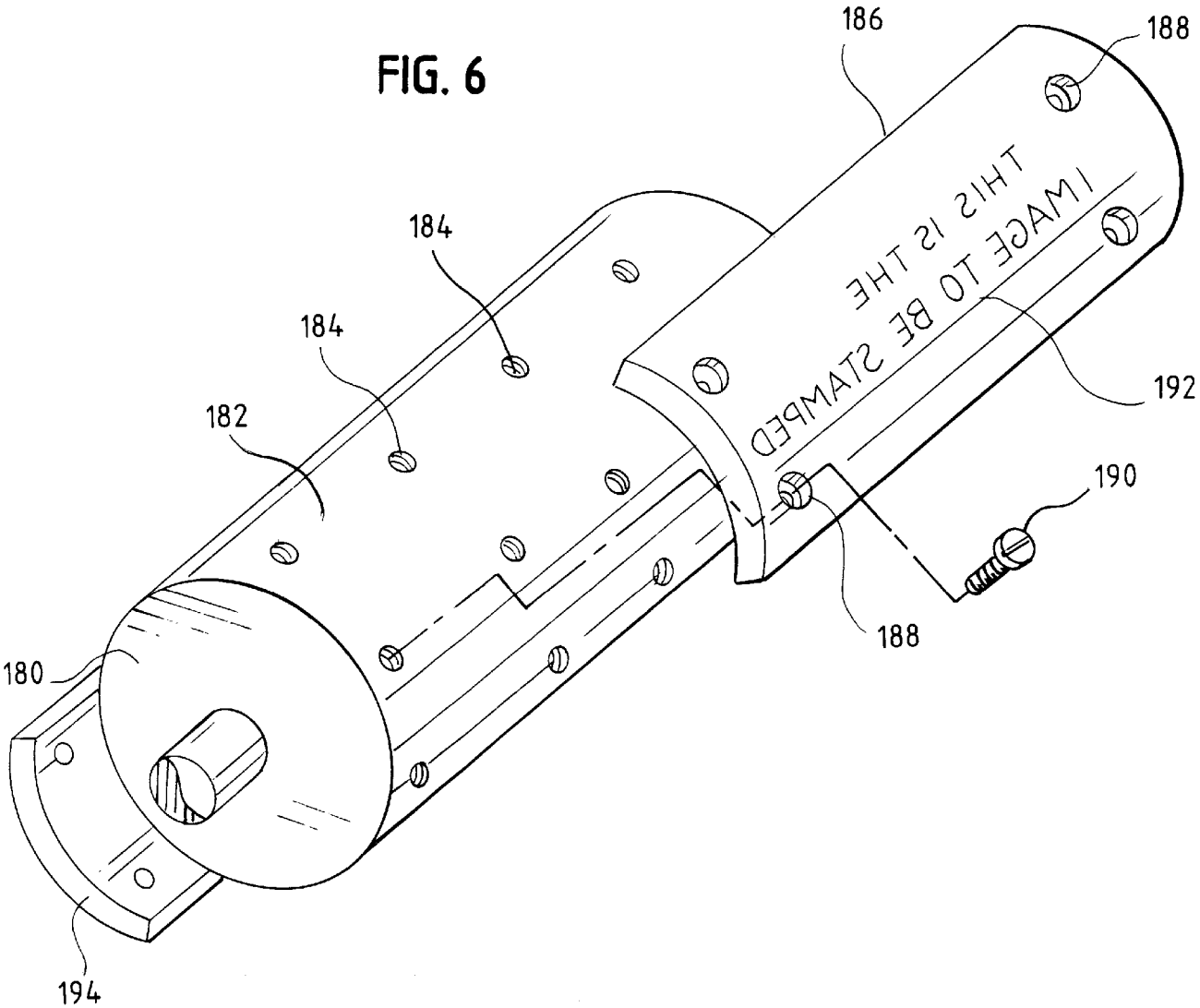
FIG. 6 is a perspective view of a rotary die holder and a detachable die which may be used in the stamping section of FIG. 3.

Turning to FIG. 6, a single die holder is shown at 180. The die holder shown may be employed in either the first or second die stations, since in the preferred embodiment, both die holders and the dies mounted thereon, are identical. As can be seen, the die holder comprises a cylindrical roll having a relatively smooth circumferential surface 182. A series of tapped holes 184 are formed at regular intervals in surface 182. A first die 186, comprises an arcuate brass plate. The inner radius of the brass plate is the same as the radius of the die holder's circumferential surface 182, so that the die may fit snugly and securely over the curved surface 182. A plurality of countersunk holes 188 are formed in the die 186 and are positioned to align with a number of the tapped holes 184 formed in the surface of the die holder. Mounting screws or bolts 190 are provided to threadably engage the tapped holes to secure the die to the die holder. The screw heads are adapted to fit within the countersunk holes 188 so as not to interfere with the raised image surfaces 192 of the die. The image surfaces of the die are slightly raised so that they will form the two dimensional contours of the image to be stamped onto the product. With the die shown in FIG. 6, the image printed on the product will read "THIS IS THE IMAGE TO BE STAMPED". Note, the image formed on the die is the mirror image of that which will be stamped onto the product. Decorative, non-textual images may also be provided. As shown, more than one die may be attached to the die holders. The total number of dies that may be attached is limited only by the angular expanse of each die, and by the necessity that a small gap exist between the raised image surfaces of each adjacent die so that the foil and product webs may be advanced unhindered by the dies between image stampings. In the arrangement shown in FIG. 6, two images will be stamped onto the product web with each revolution of the die holders.

It should be noted that in addition to a standardized die holder and removable dies, the present invention may also be carried out with a conventional rotary die on which the image surfaces protrude directly from a cylindrical roil. A drawback to using conventional dies is that it is not possible to change the stamped image quickly and economically. However, the remaining advantages of the invention such as variable product-lengths and increased production rates are retained.

Figure 7:
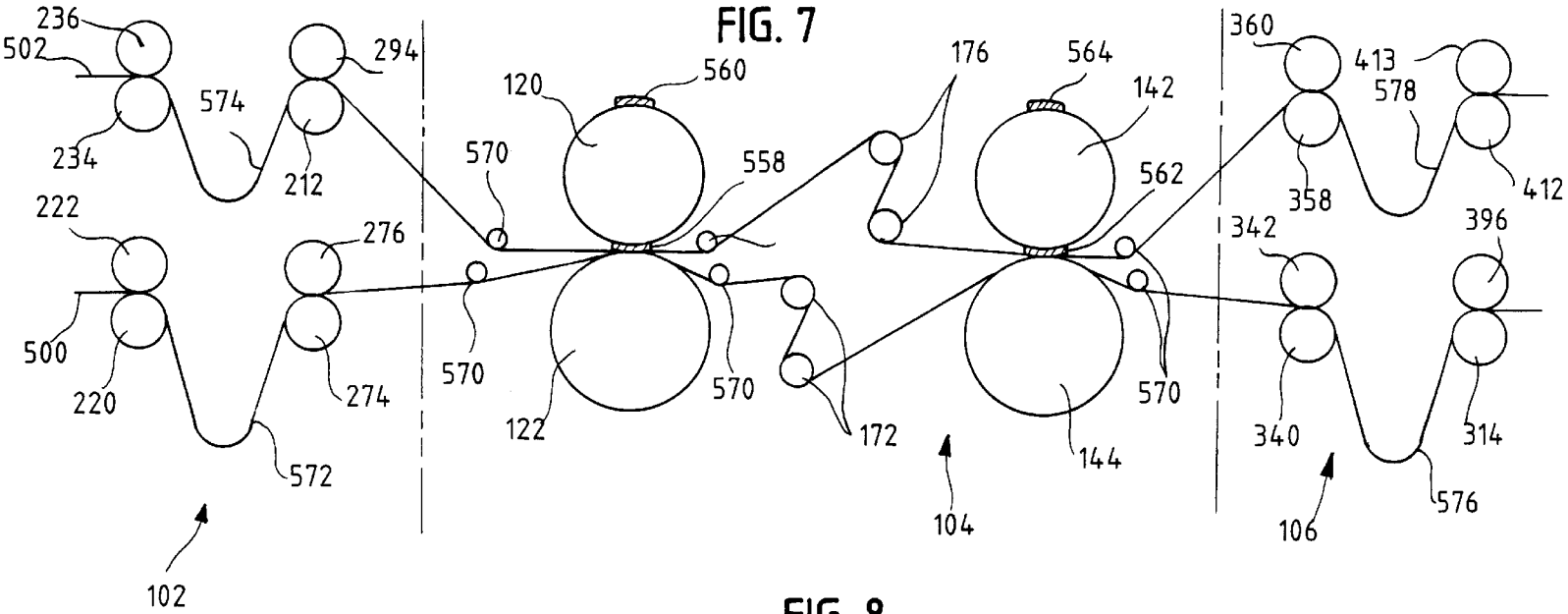
FIG. 7 is a schematic representation of the driven axes of the infeed, stamping, and out-feed sections of the rotary hot foil stamping machine of FIGS. 1–5.
Figure 8:
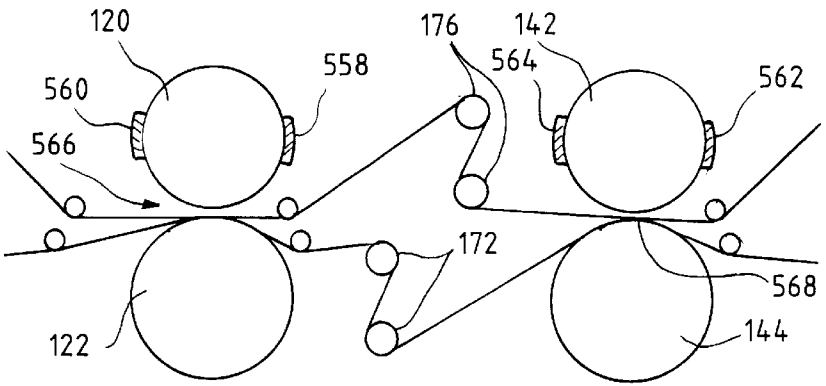
FIG. 8 is a schematic representation of the rotary die stations comprising the stamping section of FIG. 3 showing the dies rotated away from the counter rolls.

Returning to FIG. 3, and also referring to FIGS. 7 and 8 the length adjuster comprises a pair of vertical supports 170 anchored to the upper surface 109 between the first and second die stations 118, 140. A first pair of free wheeling rollers 172 are mounted on an adjustable frame 174. A second pair of free wheeling rollers 176 are mounted on an adjustable frame 178. The first pair of rollers 172 are positioned to receive a product web inter-wound therewith, and the second pair of rollers 176 are positioned to receive a foil web. The adjustable frames allow the rollers to be moved laterally with respect to each other to increase or decrease the path length that the webs must traverse between the first die station and the second die station. Thus, the position of the length adjuster rolls may be adjusted to accommodate products of various lengths. For reasons that will be become clear below, at least one full product length must be held in abeyance between the first and second die stations.

Figure 1:
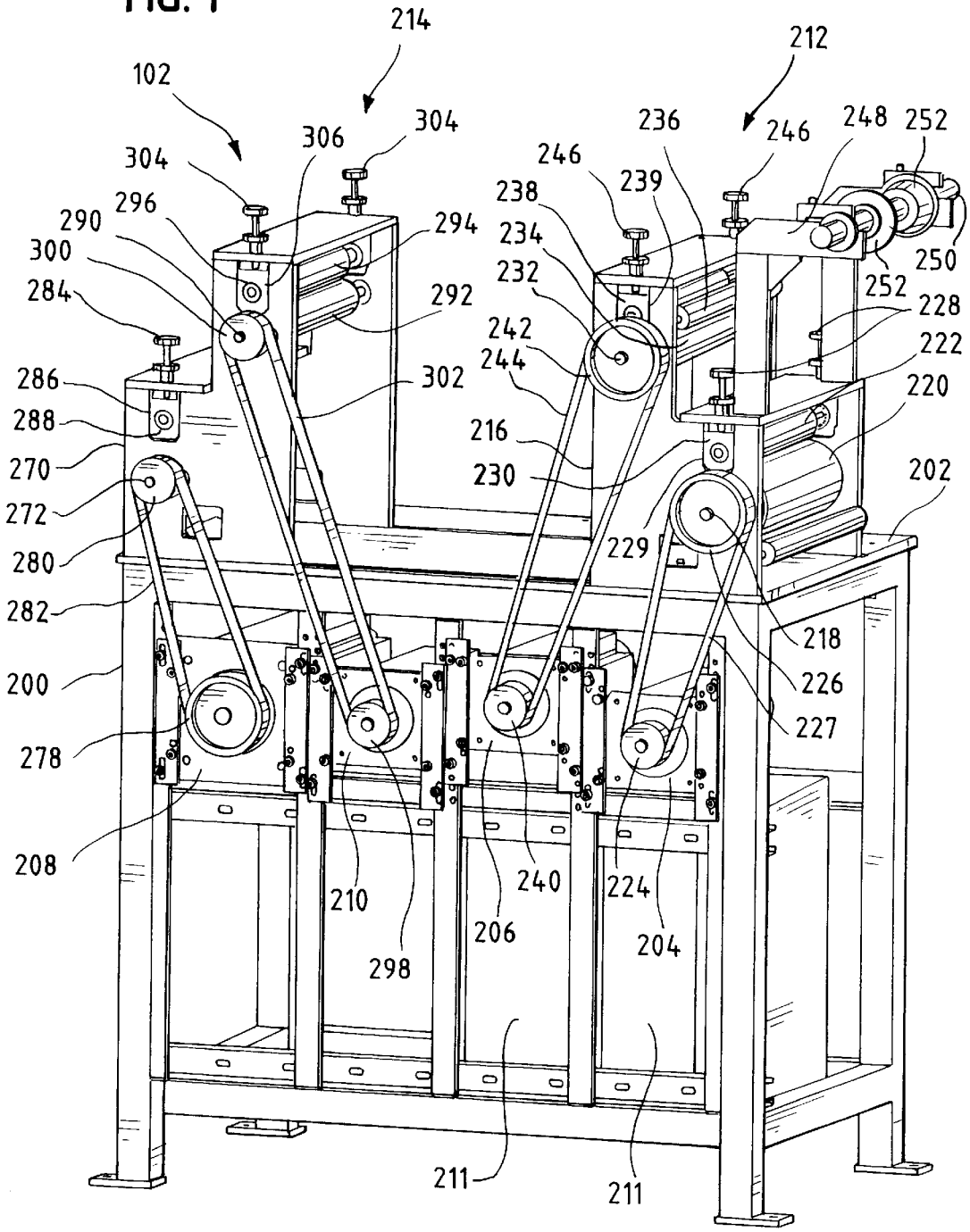
FIG. 1 is perspective view of the in-feed section of a rotary hot foil stamping machine according to a preferred embodiment of the invention.
Figure 2:
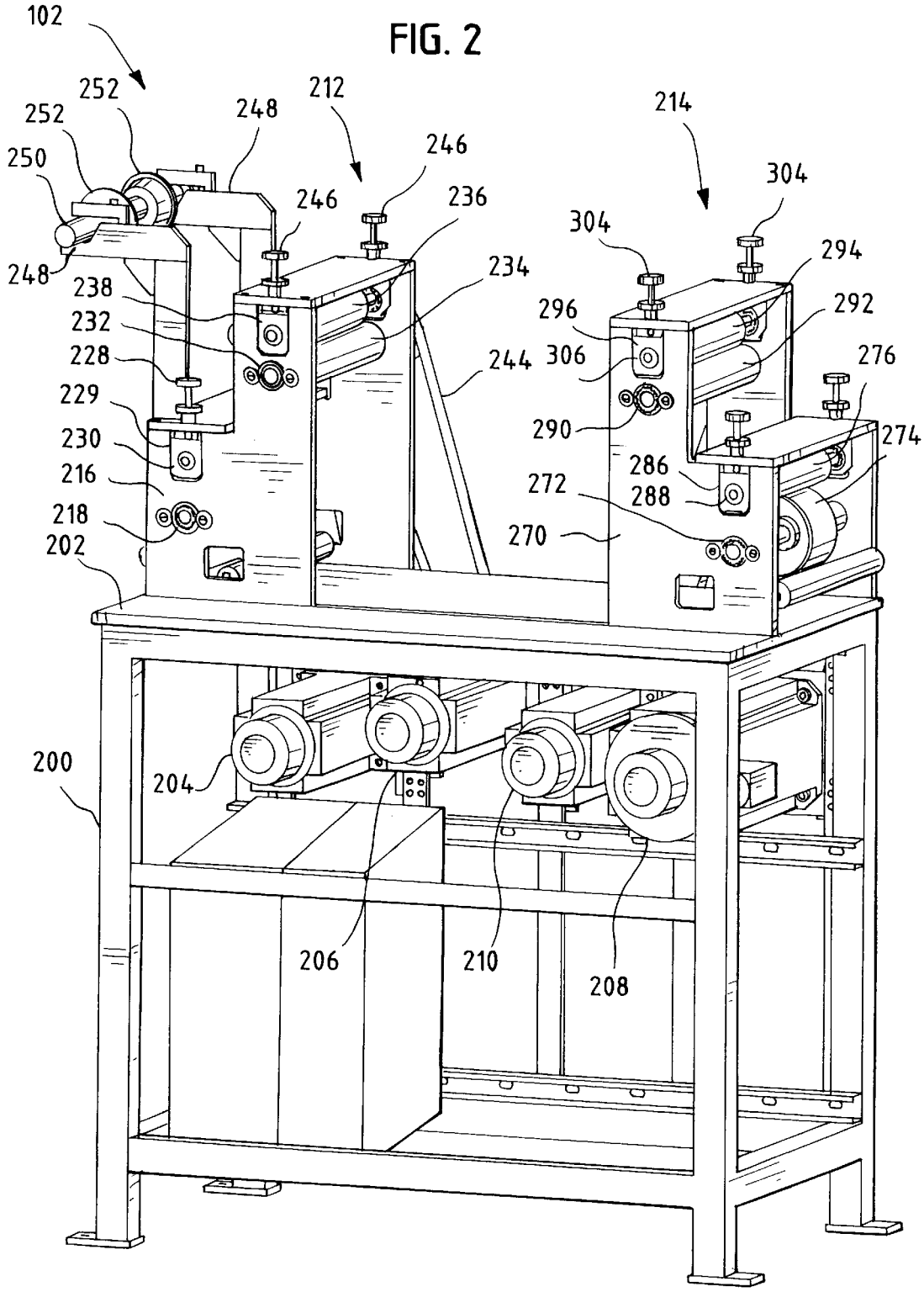
FIG. 2 is a perspective view of the in-feed section showing the reverse side of that shown in FIG. 1.

With reference to FIGS. 1 and 2, a preferred embodiment of the in-feed section 102 will now be described. The in-feed section comprises a separate base 200 having an upper surface 202. Product web and foil web pull-off axis servomotors 204, 206, and product web and foil web feed axis servomotors 208, 210 are mounted within base 200. The axis controllers 211 for each of the servomotors 204, 206, 208, and 210 are also mounted within the base.

Above the base 200, the in-feed section 102 may be further divided into a pull-off station 212 and feed station 214. Functionally, the pull-off station 212 acts to feed both a product web and a foil web at constant speeds to provide an adequate length of each to the remaining operating components of the rotary hot foil stamping machine. The product web pull-off roll is adapted to pull a product web from a wound product web storage reel, or directly from the output of another printing process. A pair of pull-off roll supports 216 are anchored to the upper surface 202. The pull-off supports support a product pull-off axis 218, and a foil pull-off axis 232. The product pull-off axis is driven by product web pull-off axis drive motor 204 via output pulley 224, drive belt 227, and transfer pulley 226. A product web pull-off roll 220 having an accurately known diameter is mounted to, and rotates with, the pull-off axis 218. A non-driven pressure roll 222 rides on top of the product web pull-off roll 220, and the product web is fed between the product web pull-off roll 220 and the pressure roll 222. The pressure roll 222 acts to hold the product web against the product web pull-off roll to prevent slipping, and to ensure that an accurate length of product web is fed with each revolution of the product web pull off roll. The compressive force applied by the pressure roll may be adjusted by tightening or loosening pressure adjusting screws 228, which act against support bearings 230 which are slidably mounted within vertical slots 229. The axis supporting pressure roll 222 is mounted within the bearing supports 230 so that a downward force applied to the support bearings is transferred to the pressure roll 222.

Mounted above the product web pull-off axis 218 is foil web pull-off axis 232. The foil web pull-off axis is driven by foil web pull-off axis drive motor 206 via output pulley 240, transfer pulley 242, and drive belt 244. A foil web pull-off roll 234 having an accurately known diameter is mounted to, and rotates with, the foil web pull-off axis 232. A non-driven pressure roll 236 rides on top of the foil web pull-off roll 234 in the same manner that pressure roll 222 rides atop the product web pull-off roll 220. The compressive force applied by the foil pressure roll 236 may be adjusted by tightening or loosening pressure adjust screws 246 which act against foil web pull-off axis support bearings 238 mounted within vertical slots 239.

Input reel support brackets 248 are mounted above the product web pull-off axis 218. Support brackets 248 support a spindle 250 on which a foil reel (not shown here) may be loaded. End plates 252 are provided to secure the foil reel on spindle 250. The foil reel is free to spin on spindle 250 such that the rotation of the foil web pull-off roll 234 unwinds the foil web from the reel.

Turning now to the feed station 214 illustrated in FIGS. 1 and 2, the feed station acts to feed both the product web and the foil web into the stamping section of the machine 104. Structurally, feed station 214 is similar to the pull-off station 212. A pair of feed roll supports 270 are anchored to the upper surface 202 of base 200. The feed roll supports 270 support a product web feed axis 272, and a foil web feed axis 290. The product feed axis is driven by product web feed axis drive motor 208 via output pulley 278, transfer pulley 280, and drive belt 282. A product web feed roll 274 having a known diameter is mounted to, and rotates with, the product web feed axis 272. A non-driven pressure roll 276 rides on top of the product web feed roll 274 to hold the product web against the product web feed roll and prevent slipping. The compressive force applied by the product web pressure roll 276 may be adjusted by tightening or loosening pressure adjusting screws 284 which act against product web pressure roll axis support bearings 288 slidably mounted within vertical slots 286.

Foil web feed axis 290 is mounted above the product web feed axis 272. The foil web feed axis is driven by foil web feed axis drive motor 210 via output pulley 298, transfer pulley 300, and drive belt 302. A foil web feed roll 292 having a known diameter is mounted to, and rotates with, the foil web feed axis 290. A non-driven pressure roll 294 rides on top of the foil web feed roll 292 to hold the foil web against the foil web feed roll and prevent slipping. The compressive force applied by the foil web pressure roll 294 may be adjusted by tightening or loosening pressure adjust screws 304 which act against foil web pressure roll axis support bearings 296 slidably mounted within vertical slots 306.

Figure 4:
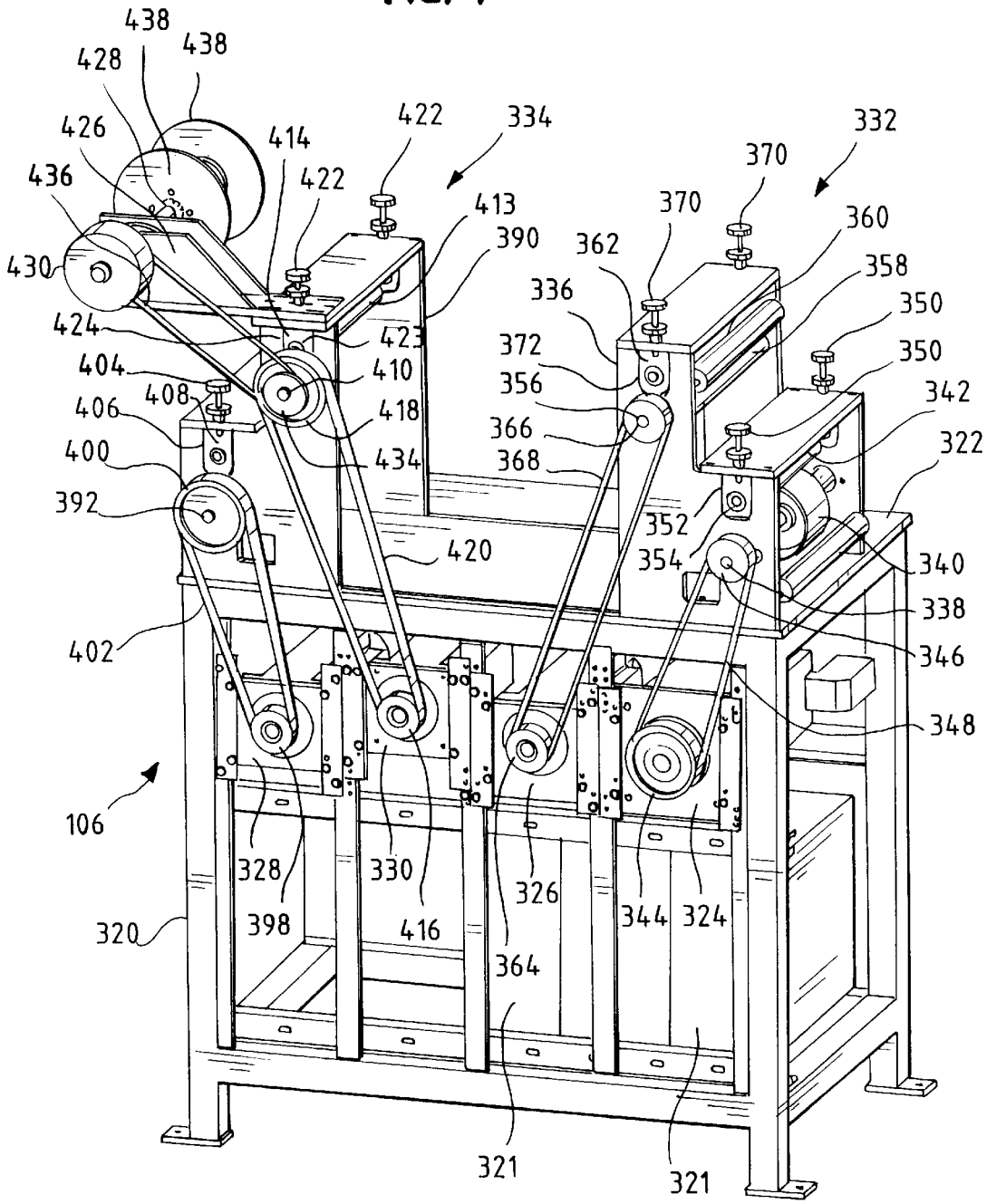
FIG. 4 is a perspective view of the out-feed section of a rotary hot foil stamping machine; according to a preferred embodiment of the invention.
Figure 5:
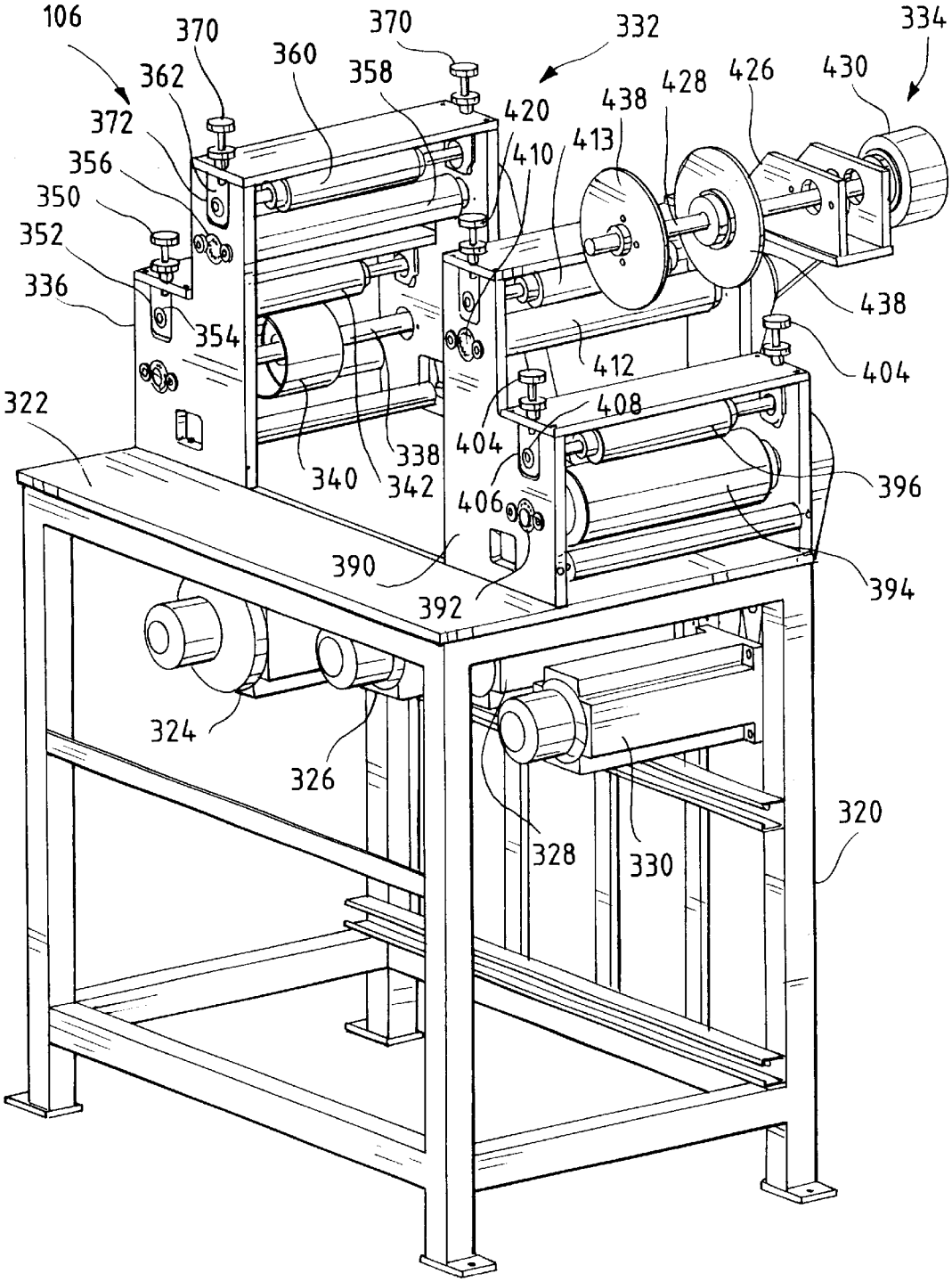
FIG. 5 is a perspective view of the out-feed section showing the reverse side of that shown in FIG. 4.

Turning to FIGS. 4 and 5, the out-feed section 106 of the rotary hot foil stamping machine of the present invention will now be described. The out-feed section is nearly a mirror image of in-feed section 104. The out-feed section comprises a separate base 320 having an upper surface 322. Product web and foil web pull-through servomotors 324, 326, and product web and foil web output servomotors 328, 330 are mounted within base 320. The axis controllers 321 for each of the servomotors 324, 326, 328, and 330 are also mounted within the base.

Above the base 320, the out-feed section 106 may be further divided into a pull-through station 332 and an output feed station 334. The pull-through station 332 acts to pull both the product web and the foil web through the die stations 118, 140 mounted on the stamping section 104 of the hot foil stamping machine (FIG. 3). As will be described in more detail below, the pull through station 332 operates synchronously with the feed station 114 of the in-feed section 102.

A pair of pull-through supports 336 are anchored to the upper surface 322 of base 320. The pull-through supports 336 support a product web pull-through axis 338, and a foil web pull-through axis 356. The product web pull-through axis is driven by product web pull-through axis drive motor 324 via output pulley 344, transfer pulley 346, and drive belt 348. A product web pull-through roll 340 having a known diameter is mounted to, and rotates with the product web pull through axis 338. A non-driven pressure roll 342 rides on top of the product web pull-through roll 340 to hold the product web against the product web pull-through roll and prevent slipping. The compressive force applied by the product web pressure roll 342 may be adjusted by tightening or loosening pressure adjusting screws 350 which act against product web pressure roll axis support bearings 354 slidably mounted in vertical slots 352.

The foil web pull-through axis 356 is mounted above the product web pull-through axis 338. The foil web pull-through axis is driven by foil web pull-through axis drive motor 326 via output pulley 364, transfer pulley 366, and drive belt 368. A foil web pull-through roll 358 having a known diameter is mounted to, and rotates with, the foil web pull-through axis 356. A non-driven pressure roll 360 rides on top of the foil web pull-through roll 358 to hold the foil web against the foil web pull-through roll and prevent slipping. The compressive force applied by the foil web pressure roll 360 may be adjusted by tightening or loosening pressure adjusting screws 370 which act against foil web pressure roll axis support bearings 362 slidably mounted within vertical slots 372.

Output feed station 334 (FIGS. 4 and 5) corresponds generally with the pull-off station 212 of the in-feed section 102 (FIG. 1). In it, a pair of output feed roll supports 390 are anchored to the upper surface 322 of base 320. The output feed roll supports 390 support a product web output feed axis 392, and a foil web output feed axis 410. The product web output feed axis 392 is driven by product web output feed axis drive motor 328 via output pulley 398, transfer pulley 400, and drive belt 402. A product web output feed roll 394 having a known diameter is mounted to, and rotates with, the output feed axis 392. A non-driven pressure roll 396 rides on top of the product web output feed roll 394, and acts to hold the product web against the product web output feed roll to prevent slipping, and to ensure that an accurate length of product web is fed with each revolution of the product web output feed roll. The compressive force applied by the pressure roll 396 may be adjusted by tightening or loosening pressure adjust screws 404, which act against pressure roll axis support bearing 408 mounted within vertical slots 406. The product web output feed roll 394 is adapted to feed the hot foil stamped product web from the hot foil stamping machine at a constant speed so that it may be processed further by other equipment, such as a winding machine or a cutting machine.

Mounted above the product web output feed axis 392 is foil web output feed axis 410. The foil web output feed axis is driven by foil web output feed axis drive motor 330 via output pulley 416, transfer pulley 418, and drive belt 420. A foil web output feed roll 412 having a known diameter is mounted to, and rotates with, the foil web output feed axis 410. A non-driven pressure roll 413 rides on top of the foil web output feed roll 412 and acts to hold the foil web against the foil web output feed roll to prevent slipping, and to ensure that an accurate length of foil web is fed with each revolution of the foil web output feed roll. The compressive force applied by the foil web pressure roll may be adjusted by tightening or loosening pressure adjusting screws 422 which act against foil web pressure roll axis support bearings 423 slidably mounted in vertical slots 424.

A support bracket 426 is mounted above the foil web output feed axis 410. Support bracket 426 is configured to hold a reel onto which the spent foil web may be wound as it is output from the foil web output feed axis. A Spindle 428 extends through the bracket 426, and a slip clutch 430 is mounted on the spindle on the side of the bracket opposite where the reel is wound. A pulley (not shown) is mounted on the slip clutch and is driven by reel drive belt 436. Belt 436 is driven from a smaller pulley 434 driven with the foil web output feed transfer pulley 418. The slip clutch ensures that there is always tension on the web so that the reel winds the spent foil web as it is fed out of the foil web output feed axis 410, however, the tension is not so great as to tear the foil web. Thus, the spent foil web is wound onto the reel immediately upon being fed from the foil web output feed roll 412. End plates 438 are provided to ensure that the spent foil web is wound neatly onto the output reel.

The operation of the rotary hot foil stamping machine will now be described with reference to FIGS. 7–11. FIG. 7 is a schematic representation of the working axes of the rotary hot foil stamping machine. Many of the elements depicted in FIG. 7 have already been described with reference to FIGS. 1–6, and the reference numbers assigned in those figures have been retained. Thus, FIG. 7 shows the in-feed section 102, including the product web pull-off roll 220 and pressure roll 222; the foil web pull-off roll 234 and pressure roll 236; product web feed roll 274 and pressure roll 276; and foil web feed roll 292 and pressure roll 294. The stamping section 104 includes first die holder 120; first counter roll 122; length adjuster rollers 172, 176; second die holder 142; and second counter roll 144. A pair of dies 558, 560 are mounted to die holder 120, and a second pair of dies 562, 564 mounted on the second die holder 142. The out-feed section 106 is shown with the product web pull-through roll 340 and pressure roll 342; the foil web pull-through roll 358 and pressure roll 360; product web output feed roll 394 and pressure roll 396; and foil web output feed roll 412 and pressure roll 413.

A product web 500 is shown threaded between the various product web rolls, and a foil web 502 is shown threaded between the various foil web rolls. Lastly, a number of free wheeling guide rolls 570 are shown. The guide rolls act to guide the webs through the die stamping stations.

Figure 9:
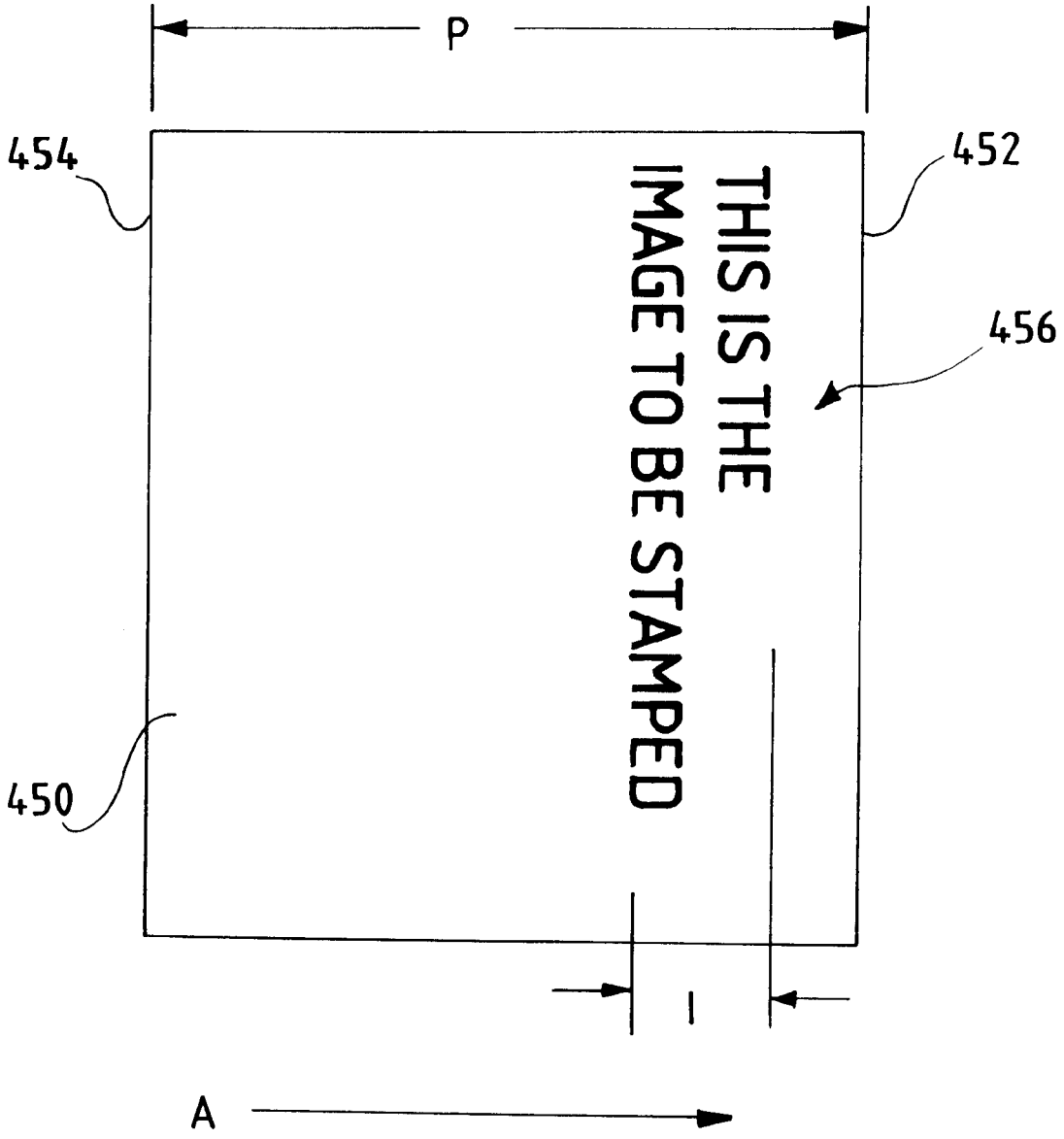
FIG. 9 is a plan view showing a typical foil-stamped product produced by the rotary hot foil stamping machine of FIGS. 1–5.

A typical product 450 to be printed by the rotary hot foil stamping machine of the present invention is shown in FIG. 9. Prior to being stamped with a foil image, product 450 is merely an indistinguishable length of the continuous product web 500. As the product web is fed through the rotary hot foil stamping machine, product 450 travels in the direction indicated by the arrow A shown in FIGS. 7 and 8. The product 450 has a product length P extending from the leading edge 452 to the trailing 454. In most applications, the trailing edge 454 of a forward most product is contiguous with the leading edge of the next adjacent product. Thus, the entire length of the product web will be taken up as product. An image 456 is stamped on the surface of product 450. The image has an image length I as shown. The image length corresponds to the length of the image measured in the direction of web travel.

In production, the rotary hot foil stamping machine will be set to operate at a particular rate. The production rate will generally be expressed in terms of a number of products per unit of time, such as for example, 200 products per minute. An average product web feed rate (e.g. ft/min.) may be calculated from the production rate by multiplying the product length (e.g. in feet) by the number of products to be produced per unit of time (e.g. products per minute). When the machine is running at its intended speed, the product web must be supplied to and removed from the first and second die stations at a rate equal to the calculated average product web feed rate. Thus, the product web pull-off roll 220 having a known circumference may be driven at a constant angular speed calculated to deliver product web to the remainder of the machine at the desired average feed rate. Similarly, the product web output roll 394 may also be driven at a speed calculated to expel the printed product web from the machine at the calculated average feed rate.

A foil web average feed rate may be calculated in the same manner. With each product produced, a length of the foil web will be consumed equal to the image length stamped onto the product. Thus, the foil web must be supplied to the die stamping section at a rate equal to the image length times the number of products to be printed per unit of time. In practice it may be desirable to increase the image length parameter to something slightly greater than the actual length of the image. This may be necessary to ensure that a sufficient amount of foil is present beneath each die to stamp an entire image onto each product. Failing to do so may cause a slight overlap of used foil where the dies are attempting to stamp foil images from areas of the foil web that have already been partially stamped. In any event, the foil web average feed rate may be calculated by multiplying the image length by the desired production rate. The foil web pull-off roll 234 and the foil web output feed roll 412 are then driven at angular speeds calculated to supply and remove the foil web to and from the rotary hot foil stamping machine at the calculated average foil web feed rate.

While the product and foil web pull-off rolls 220, 234, and the product and foil web output feed rolls 394, 412 are all driven at constant speeds, the product web feed roll 274, the foil web feed roll 292, the product web pull-through roll 340, and the foil web pull-through roll 358, are driven at non-constant or intermittent rates.

Considering the product web first, the product web feed roll 274 and the product web pull-through roll 340 work in synchronization with one another such that the product web pull-through roll 340 pulls the product web through the first and second die stations at exactly the same rate that the product web is fed into the die stations by the product web feed roll 274. Furthermore, the product web feed rate is synchronized with the rotation of the first and second die holders 120, 142.

In the preferred embodiment of the invention shown in FIG. 7, two dies are mounted to the surface of each die holder, and are located 180° apart. Each die is configured to stamp one image on a single product during each revolution of the die holder to which it is mounted. Thus, with two dies mounted to each die holder, each die holder will stamp two images with every revolution for a total of four stamped images. In terms of the overall production rate, each die holder will stamp one half of the total number of images. Since each die holder stamps two images per revolution, the die holders need only be driven at an angular velocity in revolutions per unit of time equal to one fourth the production rate.

An example is illustrative. Suppose it is desired to produce 800 products per minute. Since each die station stamps one half of the images, each die station 118, 140 must stamp 400 images per minute. Further, since each die holder stamps two images per revolution, each die holder must rotate at a speed of 200 revolutions per minute in order to achieve the desired production rate.

Figure 10:
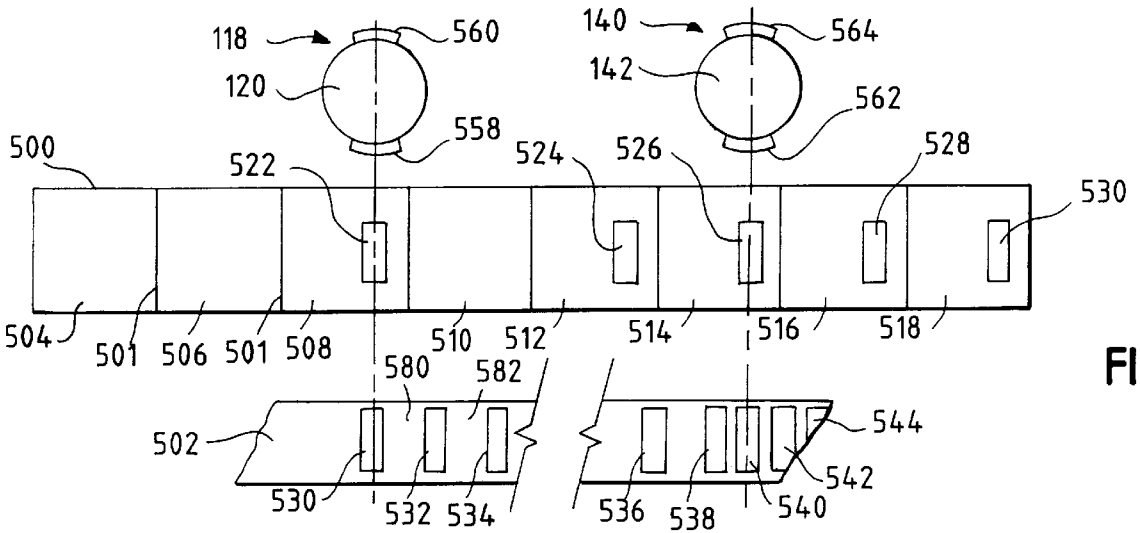
FIG. 10 is a schematic representation of a product web and a foil web, and images stamped thereon by the stamping section of FIG. 3.
Figure 11:
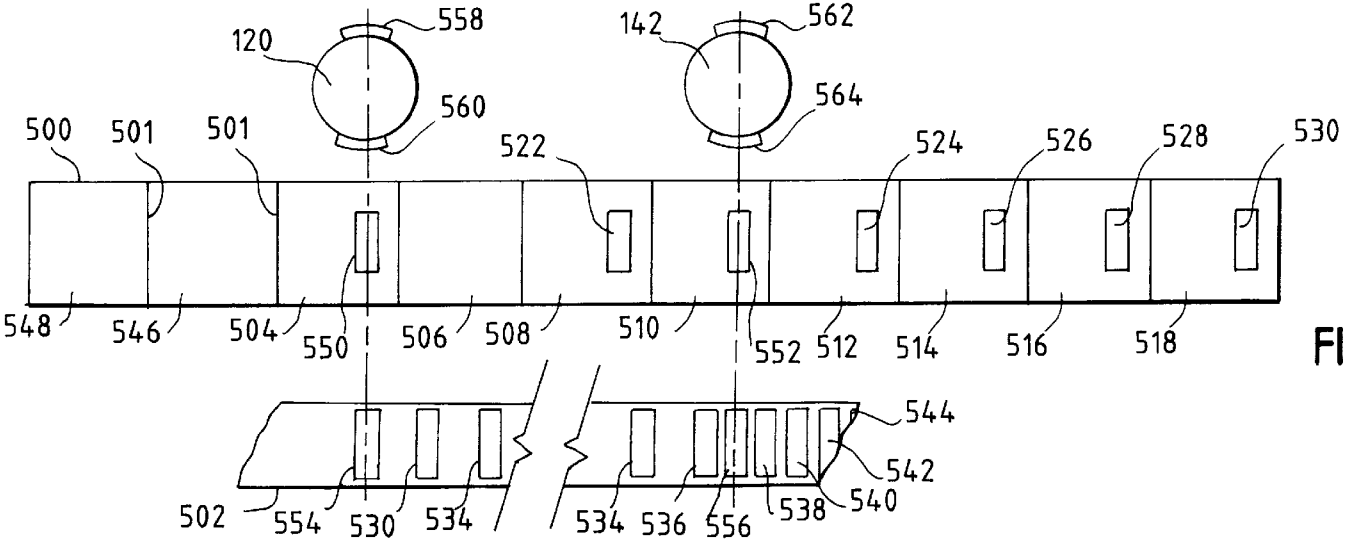
FIG. 11 is a schematic representation of the product web and foil web of FIG. 10, after they have been advanced through the first and second die stations, and positioned for the next adjacent stamping.

As for feeding the product web through the first and second die stations, a number of factors must be considered. First, as was explained in the Background of the Invention section, while the foil image is being stamped onto the product web, both the product web and the foil web must travel at the same speed as the surface of the rotating dies. This is the condition shown in FIG. 7 where the dies 558, 562 are shown abutting the counter rolls 122, 144. In FIG. 8 on the other hand, the die holders have rotated approximately 90° from the position shown in FIG. 7. Once the dies have rotated away from the counter rolls, narrow gaps 566, 568 are formed between the die holders and the counter rolls. The gaps 566, 568 remain until the dies 560, 564, mounted on the opposite side of die holders, are rotated past the counter rolls. During this brief portion of die holders' angular rotation, both the product web and the foil web are clear of the raised image portion of the dies and therefore may be fed through the first and second die stations at feed rates far in excess of the speed of the rotating dies. The rotary hot foil stamping machine of the present invention takes advantage of this to accelerate the product web feed rate such that two product lengths minus the image length are fed through the die stations between stamping operations. This allows two products to be stamped simultaneously. The first die station 118 stamps every other product length along the length of the product web, and the second die station 140 stamps those in-between. The progress of the product and foil webs 500, 502 through the first and second die stations is depicted in FIGS. 10 and 11. The product web 500 is shown divided into individual product lengths 504–518 (even numbers only) by vertical demarcation lines 501 which represent the trailing and leading edges of adjacent products on which foil images are to be stamped. The demarcation lines 501 are shown here for illustration only, and will not necessarily be printed on an actual product web when the rotary hot foil stamping machine is in production. The foil web 502 is shown with foil depleted areas 530–544 (even numbers only) where foil images have already been stamped from the Web.

A length of the product web equal to one product length P must be fed through the rotary hot foil stamping machine for each product to be produced. Since the rotary hot foil stamping machine of the present invention stamps two images simultaneously, a total length of two product lengths, 2P, must be fed through the die stations between each successive stamping. As has been previously discussed, during the actual stamping of the foil image onto the product web, the product web and the foil web both travel at the speed of the rotating dies. Thus, the product web 500 and the foil web 502 both travel a distance equal to one image length I as the first and second die stations simultaneously stamp images onto the product web. This distance traveled during stamping must be accounted for in determining the distance the product web 500 and foil web 502 must travel between stampings in order to properly position the webs to receive for the next set of stamped images as the next pair of dies are rotated past the counter rolls.

With regard to the product web 500, the image length I is simply subtracted from the total distance that the product must be fed between each stamping, namely, 2P. Thus, as the die holders 120, 142 rotate the first pair of dies 558, 562 away from the counter rolls, product web feed roll 274 and product web pull-through roll 340 are accelerated to pull the product web 500 through the gaps 566, 568 formed between die holders 120, 142 at high speed, so that a total length of product web equal to exactly two product lengths minus one image length (2P-I) is fed through the die stations 118, 140 before the next set of dies 560, 564 stamp the next set of foil image onto product web 500. Once the product web is in the correct position, the product-web fed roll 274 and the product-web pull-through roll are slowed, to synchronize the speed of the product web with that of the next pair of dies 560, 564 as they are rotated past the counter rolls 122, 144.

The foil web 502 must be fed in a similar intermittent manner. However, because the image length I is much less than the overall product length P, the foil web need not be accelerated between stampings to the same extent as the product web. A length of the foil web, equal to twice the image length, 2I, must be fed through the die stations 118, 140 with each stamping operation. As has already been noted, it may be desirable to feed slightly more than 2I for each stamping, in order to avoid overlap between stampings, and to ensure that foil has not been depleted from portions of the web that will be later stamped to form succeeding images. As with the product web, one image length worth of the foil web 502 will be fed during the course of each stamping. Therefore, only one additional image length I must be fed through the die stations 118, 140 between gaps 566, 568. Thus, the foil web in-feed roll 292 is accelerated only to the point where one additional image length is fed through the die stations 118, 140 before the next image is stamped. Furthermore, once the proper length of foil-web 502 is fed, the foil-web feed roll 292 is changed to match the speed of the approaching dies.

The intermittent speeds at which the product web in-feed roll 274 and the foil-web in-feed roll 292 feed the product web and foil web through the die stations requires a ready supply of both the product web and the foil web which may be drawn upon without tearing the webs as they are rapidly accelerated and decelerated through the first and second die stations. Such is provided in the form of a product web control loop 572 disposed between the product web pull off roll 220 and the product web feed roll 274, and a foil web control loop 574 disposed between foil web pull off roll 234 and the foil web feed roll 292. Though the product web feed roll and the foil web feed roll operate at intermittent speeds, the overall average speed at which the product web and the foil web are fed into the stamping section are equal to the substantially constant feed rates at which the product web pull-off roll 220 and the foil web pull-off roll supply the product web and foil web. Thus, when the product web feed roll 274 accelerates, the first product web control loop is rapidly depleted, but not to the extent that the entire loop is removed. During the period when the product web is being stamped and the product web feed roll 274 is slowed, the product web pull-off roll 220 replenishes the loop to the point where there is sufficient slack in the control loop to accommodate the next accelerated feed cycle. The first foil web control loop 574 operates in a similar manner.

On the output side of the rotary hot foil stamping machine, a second product web control loop 576 is formed between the product-web pull-through roll 340 and the product-web output roll 394. Similarly, a second foil web control loop 578 is formed between the foil web pull-through roll 358 and the foil-web output roll 412. On the output side of the machine, however, the operation is reversed. The control loops 576, 578 are intermittently supplied by the product web pull-through roll 340 and the foil-web pull-through roll 358, and the control loops are steadily depleted by the constant speed product-web output roll 394 and foil-web output roll 412.

As the product and foil webs 500, 502 are fed through the stamping section of the machine 104, the first die station 118 and the second die station 140, each stamp one half of the products produced by the machine. The alternating pattern by which the first and second die stations 118, 140 stamp products is best seen by comparing FIGS. 10 and 11. FIG. 10 shows the product and foil webs 500, 502 as a first set of dies 558, 562, stamp a pair of images onto the product web. FIG. 11 shows the same product web 500 and foil web 502 after they have been advanced, and are positioned to be stamped by the next pair of dies 560, 564.

In FIG. 10, previously stamped images are shown at 524, 528, and 530. Images 522 and 526 are formed as dies 558, 562 are rotated past products 508 and 514 respectively. Products 508, 512 and 516 are stamped by the first die station, and products 514, and 530 are stamped by the second die station 140. Product 510, which has not been stamped, but which has already been fed past the first die station, will be stamped by the second die station after the product web 500 and foil web 502 are advanced during the next stamping cycle, as shown in FIG. 11. Thus, as the first and second die stations stamp the product web, at least one product length must be held in abeyance between the die stations. The variable length adjusters located between the die stations may be adjusted to accommodate products of varying lengths, so that at least one unstamped product may be stored between the first and second die stations.

In FIG. 10, the locations where previous images have been stamped from the foil web 502 are shown at 532, 536, 538, 542, and 544. Furthermore, the location from where the current images 522, 526 are being stamped are shown at 530 and 540. As has already been discussed, it is desirable to advance the foil web 502 a distance slightly greater than 1 image length to ensure that there is sufficient foil available to form each stamped image. After the foil web has passed through the first die station, spaces 580, 582 comprising unused sections of the foil web appear between the used foil locations 530,532, and 534. Spaces 580, 582 will be slightly longer than one image length I. As the foil web is advanced through the second die station 140, images are stamped from the foil web at locations corresponding to the spaces 580, 582. Thus, after the foil web has passed through the second die station, the used portions of the foil web form a tight, closely spaced pattern along the length of the web, effectively utilizing the entire length of the foil web.

Figure 12:
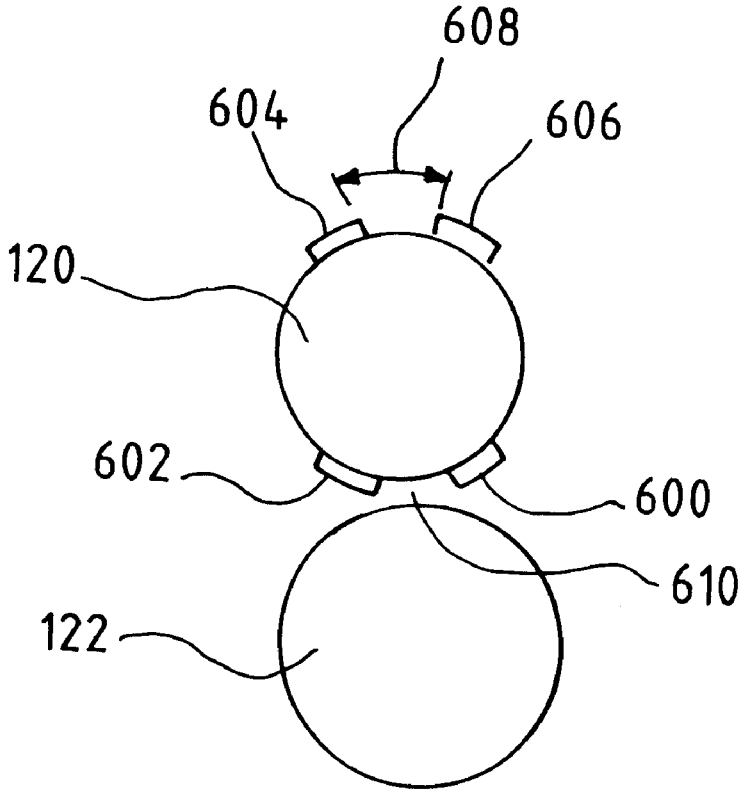
FIG. 12 is a schematic representation of the stamping section of FIG. 3 according to an alternate embodiment of the invention.

Turning briefly to FIG. 12, some applications will require the foil image to be stamped by two separate dies 600, 602, and 604, 606 angularly spaced apart, on the surface of the die holder. As can be seen, an additional small gap 610 is formed between the die holder and the counter roll during the period when the angular space 608 between the pair of dies 600, 602, or 604, 606, is rotated opposite the counter roll. In order to conserve the foil web 502, forward feeding of the web may be halted or slowed until the next adjacent die engages the counter roll. At that time, feeding of the foil web at a rate equal to the speed of the die may be resumed, and the stamping process continued as previously described.

Returning to the comparison of FIGS. 10 and 11, the die holders 120, 142 shown in FIG. 11 have been rotated 180° from their position in FIG. 10. Furthermore, the product web 500 and foil web 502 have advanced to the proper position for stamping the next pair of images onto the product web. Comparing the position of the product web 500 in FIG. 11 to that in FIG. 10, it can be seen that the product web has advanced two full products lengths, 2P. Thus, product 504 is now located at the first die station, and product 508, has advanced from the first die station to an intermediate position between the first and second die stations. Additionally, product 510 which had not been stamped by the first die station, but was located between the first and second die stations in FIG. 10, has been advanced to the second die station 140. Product 512 which in FIG. 10 had been previously been stamped by the first die station 118 and was located between the first and second die stations, in FIG. 11 has been advanced past the second die station. For the product web to advance from the position shown in FIG. 10 to that of FIG. 11, a length of the product web equal to twice the product length (2P) must be fed through the first and second die stations. As has already been described, a distance of one image length I is fed during the stamping operation itself, and the remaining portion of the feed length 2P-I is fed during the interim between the stamping of images 522, 524 and the stamping of later images 550, 552 by dies 560, 564.

For its part, the foil web 502 advances a distance equal to twice the image length between FIGS. 10 and 11, (plus twice the separation between adjacent stampings, if required.) As with the product web, the foil web is fed a distance equal to one image length (I) during the stamping operation itself, and the remaining portion of the foil web feed length occurs during the interim between the stamping of images 522, 524 and the stamping of later images 550, 552.

By supplying a second die station, and increasing the product web and foil web feed rates between stampings, the output of the rotary hot foil stamping machine is effectively doubled. A further advantage of the rotary hot foil stamping machine of the present invention is that the product length is not dependent on the diameter of the die holders 120, 142. The same die holders may be used over and over for production runs having widely varying product lengths. All that is required is changing the segmented dies attached to the die holders, and re-programming the axis controllers to include the production parameters corresponding to the particular product to be produced.

In addition to the rotary hot foil stamping machine just described, the invention further comprises a method of repeatedly stamping a hot foil image onto the surface of a product web. The method involves providing a rotary die holder and counter roll and positioning the die holder such that a rotary die attached to a surface of the die holder engages the surface of the counter roll as the die is rotated past the counter roll. The rotary die extends over less than the entire circumference of the die holder such that during a portion of the die holder's rotation, a gap is formed between the die holder and the counter roll.

The method further includes threading the product and foil webs between the die holder and the counter roll, and rotating the die holder at a constant speed such that the die periodically engages the counter roll, stamping the foil web against the product roll with the counter roll providing a backing surface. The die is heated to facilitate stamping a foil image defined by the contours of the die from the foil web onto the product web.

During the course of the die holder's rotation, the product web and the foil web are fed past the die holder and the counter roll at least two distinct feed rates. During the period of die holder rotation when the die is stamping the foil image onto the product web, both the foil web and the product web are fed at a feed rate corresponding to the linear speed of the rotating die. After the die has rotated clear of the counter roll, however, the product web is fed at a second faster feed rate such that the product web is fed a predetermined length before the next die (either the same die that stamped the previous image, or a second die mounted to the die holder) is rotated past the counter roll to stamp the next foil image onto the product web. Similarly, in the interval between image stampings, the foil web is fed at a feed rate necessary to provide an unused length of the foil web from which an image has not yet been stamped to the next die as it is rotated past the counter roll.

By altering the feed rates of both the product web and the foil web between image stampings, the product length between stampings is made independent of the diameter of the die holders. In other words, products of varying lengths may be made with a single die holder. Further, different images may be stamped by merely attaching a different die to the surface of the die holder.

The method of the present invention may be further refined by supplying a second die holder and a second counter roll, and feeding the product and foil webs therebetween in the same manner as with the first die holder and counter roll. According to this aspect of the invention, during the interval between stampings the product web feed rate may be accelerated to feed a total length of the product web equal to two product lengths minus the image length between stampings. Also, the foil web feed rate may be accelerated between stampings to feed an additional length of the foil web equal to one image length. By increasing the product web and foil web feed rates between image stampings in this manner, the first die holder stamps foil images onto the product web in a pattern corresponding to every-other product length. The second die holder stamps foil images on the remaining product lengths in between those stamped by the first die holder. In this way the production rate is effectively doubled.

It should be noted that various changes and modifications to the present invention may be made by those of ordinary skill in the art without departing from the spirit and scope of the present invention which is set out in more particular detail in the appended claims. Furthermore, those of ordinary skill in the art will appreciate that the foregoing description is by way of example only, and is not intended to be limiting of the invention as described in such appended claims.

What is claimed is:

1. A method of repeatedly stamping a foil image onto an elongated product web, each said stamped image being positioned a fixed longitudinal distance apart along said product web, said fixed distance corresponding to a defined product length, the method comprising the steps of:

providing a rotary die holder having a rotary die thereon, said die extending over less than the full circumference of said die holder and defining a raised surface in the form of the image to be stamped onto said product web;

providing a rotary counter roll, and positioning said counter roll adjacent to and spaced apart from said die holder such that the surface of the die engages said counter roll when the die holder rotates the die between the die holder and the counter roll;

rotating said die holder at a constant speed so that the surface of the die is rotated against said counter roll at regular timed intervals;

feeding a product web and a foil web in a forward direction between said die holder and said counter roll at a first feed rate during the periods when the surface of the die is engaging the counter roll;

feeding said product web in a forward direction at a second product web feed rate during a period when the surface of the die does not engage said counter roll, wherein the second product web feed rate is different than the first product web feed rate, and wherein the second product web feed rate is greater than the first product web feed rate.

2. The method of claim 1, wherein the step of providing a rotary die holder further comprises attaching two substantially identical removable dies to said die holder diametrically opposite one another so that two images are stamped onto said web with each full rotation of said die holder.

3. The method of claim 2, further comprising the step of reducing the foil feed rate to zero during those periods of the die holder rotation when the surfaces of said dies are do not engage said counter roll.

4. The method of claim 3, wherein each foil stamped image is formed from a plurality of die surfaces circumferentially spaced adjacent one another around the circumference of said die holder, with angular gaps separating the surfaces of adjacent dies forming portions of the same image, said method further comprising the step of reducing the foil feed rate during those periods of the die carrier rotation when said angular gaps between surfaces of adjacent dies forming portions of the same image are rotated past the counter roll.

5. The method of claim 3, wherein each foil stamped image is formed from a plurality of die surfaces circumferentially spaced adjacent one another around the circumference of said die holder, with angular gaps separating the surfaces of adjacent dies forming portions of the same image, said method further comprising the step of reducing the foil feed rate to zero during those periods of the die holder rotation when said angular gaps between surfaces of adjacent dies forming portions of the same image are rotated past the counter roll.

6. The method of claim 3, wherein each foil stamped image is formed from a plurality of die surfaces circumferentially spaced adjacent one another around the circumference of said die holder, with angular gaps separating the surfaces of adjacent dies forming portions of the same image, said method further comprising the step of reversing the feed direction of the foil web during those periods of the die carrier rotation when said angular gaps between surfaces of adjacent dies forming portions of the same image are rotated past the counter roll.

7. A method of repeatedly stamping a foil image onto an elongated product web, each said stamped image being positioned a fixed longitudinal distance apart along said product web, said fixed distance corresponding to a defined product length, the method comprising the steps of:

providing a rotary die holder having two substantially identical removable rotary dies thereon, each said rotary die defining a raised surface in the form of the image to be stamped onto said product web;

providing a rotary counter roll, and positioning said counter roll adjacent to and spaced apart from said die holder such that the surface of the die engages said counter roll when the die holder rotates the die between the die holder and the counter roll;

rotating said die holder at a constant speed so that the surface of the die is rotated against said counter roll at regular timed intervals;

feeding a product web and a foil web between said die holder and said counter roll at a first feed rate during the periods when the surface of the die is engaging the counter roll;

feeding said product web at a second product web feed rate during a period when the surface of the die does not engage said counter roll, attaching the two substantially identical removable dies to said die holder diametrically opposite one another so that two images are stamped onto said web with each full rotation of said die, wherein the circumferential length of the raised die surfaces defines an image length;

providing a second die holder and a second counter roll substantially identical to said first die carrier and counter roll;

rotating said second die holder synchronously with said first die holder such that the surface of the rotary dies on the second die holder engage and disengage the second counter roll simultaneously with the surfaces of the dies on the first die holder engaging and disengaging the first counter roll;

feeding said foil web at a second foil feed rate during those periods of the die holder rotation when the surfaces of the dies are not engaging said counter rolls, said second foil feed rate being sufficient to feed a length of foil equal to at least one image length prior to the next rotation of die surfaces against said counter rolls; and wherein said step of feeding said product web at a second feed rate comprises feeding a length of said product web equal to twice the product length minus the image length.

8. The method of claim 7, wherein each foil stamped image is formed from a plurality of die surfaces circumferentially spaced adjacent one another around the circumference of said die holder, with angular gaps separating the surfaces of adjacent dies forming portions of the same image, said method further comprising the step of reducing the foil feed rate during those periods of the die holder rotation when said angular gaps between surfaces of adjacent dies forming portions of the same image are rotated past the counter roll.

9. The method of claim 7, wherein each foil stamped image is formed from a plurality of die surfaces circumferentially spaced adjacent one another around the circumference of said die holder, with angular gaps separating the surfaces of adjacent dies forming portions of the same image, said method further comprising the step of reducing the foil feed rate to zero during those periods of the die holder rotation when said angular gaps between surfaces of adjacent dies forming portions of the same image are rotated past the counter roll.

10. The method of claim 7, wherein each foil stamped image is formed from a plurality of die surfaces circumferentially spaced adjacent one another around the circumference of said die holder, with angular gaps separating the surfaces of adjacent dies forming portions of the same image, said method further comprising the step of reversing the feed direction of the foil web during those periods of the die holder rotation when said angular gaps between surfaces of adjacent dies forming portions of the same image are rotated past the counter roll.

11. A rotary hot foil stamping machine comprising:

a rotary die having a raised image surface extending over a portion of the circumferential surface thereof;

a counter roll having a cylindrical surface rotatably mounted adjacent to and spaced apart from the rotary die, the spacing between the counter roll and die being such that the raised image surface of the die engages the surface of the counter roll when the raised image surface of the die is rotated against the counter roll;

means for feeding a product web in a forward direction between the rotary die and the counter roll, the product web feeding means operative to feed the product web forward at a first product web feed rate when the image surface engages the counter roll, and forward at a second product web feed rate when said image surface does not engage the counter roll, wherein the second product web feed rate is different than the first product web feed rate; and means for feeding a foil web between the rotary die and the counter roll and adjacent the product web, the foil web feeding means operative to feed the foil web at a first foil web feed rate when the image surface engages the counter roll, wherein the second product web feed rate is greater than the first product web feed rate.

12. The rotary hot foil stamping machine of claim 11, wherein said rotary die comprises a cylindrical die holder and a first detachable die mounted to said die holder.

13. The rotary hot foil stamping machine of claim 12, further comprising a second detachable die mounted to said die holder, said second die being angularly spaced from said first detachable die.

14. The rotary hot foil stamping machine of claim 12 wherein said die holder is servo driven such that the rotary die holder rotates the raised image surface of the die at a known linear velocity, and the rotation of the rotary die is synchronized with product web feeding means and the foil web feeding means so that said first product web feed rate and the first foil web feed rate are equal to the linear velocity of the raised image surface of the die.

15. The rotary hot foil stamping machine of claim 11 wherein said product web feeding means comprises a servo driven product web feed roll located on an input side of said rotary die and counter roll, and a servo driven product web pull-through roll located on an output side of the die holder and counter roll.

16. The rotary hot foil stamping machine of claim 11 further comprising a second rotary die and a second counter roll, said product web feeding means and said foil web feeding means operative to feed said product web and said foil web between both said first rotary die and counter roll and said second rotary die and counter roll.

17. The rotary hot foil stamping machine of claim 11 wherein the foil web feeding means is operative to feed the foil web at a second foil web feed rate when the image surface does not engage the counter roll.

18. A rotary hot foil stamping machine comprising:

a rotary die having a raised image surface extending over a portion of the circumferential surface thereof;

a counter roll having a cylindrical surface rotatably mounted adjacent to and spaced apart from the rotary die, the spacing between the counter roll and die being such that the raised image surface of the die engages the surface of the counter roll when the raised image surface of the die is rotated against the counter roll;

means for feeding a product web between the rotary die and the counter roll, the product web feeding means operative to feed the product web at a first product web feed rate when the image surface engages the counter roll, and at a second product web feed rate when said image surface does not engage the counter roll, said product web feeding means comprising a servo driven product web feed roll located on an input side of said rotary die and counter roll, and a servo driven product web pull-through roll located on an output side of the die holder and counter roll; and means for feeding a foil web between the rotary die and the counter roll and adjacent the product web, the foil web feeding means operative to feed the foil web at a first foil web feed rate when the image surface engages the counter roll, and at a second foil web feed rate when the image surface does not engage the counter roll, said foil web feeding means comprising a servo driven foil web feed roll located on an input side of said rotary die and counter roll, and a servo driven foil web pull-through roll located on an output side of the rotary die and counter roll.

19. A rotary hot foil stamping machine comprising:

a rotary die having a raised image surface extending over a portion of the circumferential surface thereof, said rotary die comprising a cylindrical die holder and a first detachable die mounted to said die holder;

a counter roll having a cylindrical surface rotatably mounted adjacent to and spaced apart from the rotary die, the spacing between the counter roll and die being such that the raised image surface of the die engages the surface of the counter roll when the raised image surface of the die is rotated against the counter roll;

means for feeding a product web between the rotary die and the counter roll, the product web feeding means operative to feed the product web at a first product web feed rate when the image surface engages the counter roll, and at a second product web feed rate when said image surface does not engage the counter roll, wherein said second product web feed rate is greater than the first product web feed rate; and means for feeding a foil web between the die holder and the counter roll and adjacent the product web, the foil web feeding means operative to feed the foil web at a first foil web feed rate when the image surface engages the counter roll, and at a second foil web feed rate when the image surface does not engage the counter roll, wherein said die holder is servo driven such that the rotary die holder rotates the raised image surface of the die at a known linear velocity, and the rotation of the rotary die is synchronized with product web feeding means and the foil web feeding means so that said first product web feed rate and the first foil web feed rate are equal to the linear velocity of the raised image surface of the die.

20. A rotary hot foil stamping machine for repeatedly stamping a foil image onto a continuous product web at a consistent interval along the length of said product web, said interval corresponding to a predefined product length, said hot foil stamping machine comprising:

first and second die stations, each die station comprising a servo driven rotary die holder having a first die removably attached thereto, and a counter roll mounted adjacent each said die holder such that an outer surface of the dies engage the counter rolls as said dies are rotated past the counter rolls, said die holders being driven together at a constant speed such that said die surfaces engage said counter rolls simultaneously and at regular timed intervals;

a product web feed roll and a product web pull-through roll, the product web feed and pull-through rolls being driven synchronously with said die holders to transport said product web through the first and second die stations at a first product web feed rate during the portion of the die holder's rotation when said dies are rotated against the counter rolls, and at a second product web feed rate when the dies are rotated away from the counter rolls; and a foil web feed roll and a foil web pull-through roll, the foil web feed and pull-through rolls being driven synchronously with said die holders to feed said foil web through the first and second die stations adjacent the product web at a first foil web feed rate during the portion of the die holder's rotation when said dies are rotated against the counter rolls, and at a second foil web feed rate when the dies are rotated away from the counter rolls.

21. The rotary hot foil stamping machine of claim 20 wherein the first product web feed rate and the first foil web feed rate correspond to the linear velocity of the dies as they are rotated by the die holders, such that the product and foil webs travel between the die holders and the counter rolls at substantially the same speed as the dies.

22. The rotary hot foil stamping machine of claim 21 further comprising a second rotary die removably attached to each of the first and second die holders diametrically opposite said first dies, each said first and second die extending over less the 180° of the circumference of the die holders such that angular gaps separate the surfaces of the first and second dies, the product web feed and pull-through rolls feeding the product web at said second product web feed rate and said foil feed and pull-through rolls feeding the foil web at the second foil web feed rate when said angular gaps are rotated adjacent the counter rolls.

23. The rotary hot foil stamping machine of claim 22 further comprising a production rate operating parameter whereby the rotary hot foil stamping machine may be selectively operated at a desired speed to stamp a specified number of images onto the product web per specified unit of time, said die holders being driven at an angular speed wherein the number of die holder revolutions per unit of time equals one fourth the production rate.

24. The rotary hot foil stamping machine of claim 22 wherein an image length is defined by the length of the stamped images as measured along the length of the product web, said second product web feed rate being sufficient to feed a length of the product web equal to twice the product length minus the image length during the timed intervals between the die surfaces engaging the counter rolls.

25. The rotary hot foil stamping machine of claim 24 wherein said second foil web feed rate is sufficient to feed a length of the foil web equal to at least one image length during the timed intervals between the die surfaces engaging the counter rolls.

26. The rotary hot foil stamping machine of claim 25 further comprising a product web take-off roll configured to receive said product web and continuously feed said product web at a constant speed into a product web input control loop located between said product web take-off roll and said product web feed roll.

27. The rotary hot foil stamping machine of claim 25 further comprising a foil web take-off roll configured to receive said foil web and continuously feed said foil web at a constant speed into a foil web input control loop located between said product web take-off roll and said product web feed roll.

28. The rotary hot foil stamping machine of claim 25 further comprising a product web output roll configured to continuously remove at constant speed said product web from a product web output control loop located between said product web pull through roll and said product web output roll.

29. The rotary hot foil stamping machine of claim 25 further comprising a foil web output roll configured to continuously remove at constant speed said foil web from a foil web output control loop located between said foil web pull through roll and said foil web output roll.

* * * * *